US006814065B1

(12) United States Patent
Butler, Jr.

(10) Patent No.: US 6,814,065 B1
(45) Date of Patent: Nov. 9, 2004

(54) CONTROL APPARATUS FOR STAGGERED SPARK PLUG FIRING IN A DUAL-PLUG SPARK IGNITION ENGINE

(75) Inventor: Raymond O. Butler, Jr., Anderson, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/669,914

(22) Filed: Sep. 24, 2003

(51) Int. Cl.[7] ..... F02P 15/08
(52) U.S. Cl. ..... 123/638; 123/636
(58) Field of Search ..... 123/636, 638, 123/594, 604, 618

(56) References Cited

U.S. PATENT DOCUMENTS 5,692,484 A * 12/1997 Downey ..... 123/643
6,186,130 B1 2/2001 Skinner et al.
6,213,108 B1 4/2001 Boyer et al.

* cited by examiner

*Primary Examiner*—Bibhu Mohanty
(74) *Attorney, Agent, or Firm*—Jimmy L. Funke

(57) ABSTRACT

Staggered firing of first and second spark plugs in a dual-plug spark ignition engine is achieved by apparatus that fires the first spark plug based on an output signal produced by an engine control module and firing the second plug based on the output of a delay control circuit responsive to the output signal produced by the engine control module. The delay control circuit additionally detects engine speed based on the firing frequency of the first spark plug, and selects a delay time so that the firing of the second spark plug is delayed with respect to the firing of the first spark plug by a calibrated angle of engine rotation.

5 Claims, 2 Drawing Sheets

CONTROL APPARATUS FOR STAGGERED SPARK PLUG FIRING IN A DUAL-PLUG SPARK IGNITION ENGINE

TECHNICAL FIELD

The present invention is directed to apparatus for achieving staggered firing of spark plugs in a dual-plug spark internal combustion ignition engine, and more particularly to a low-cost control implementation that requires only a single output from the engine control module.

BACKGROUND OF THE INVENTION

In general, a dual-plug engine is a spark-ignition internal combustion engine that is equipped with two spark plugs per cylinder in order to achieve improved performance and/or exhaust emission control. Although these improvements can be optimized when the two spark plugs are fired in staggered relation, the expense associated with individual spark plug control can be considerable because the number of coil driver circuits (ignitors) and engine control module (ECM) outputs is doubled. The cost impact is particularly high in applications where the ignitors are up-integrated into the ECM due to packaging difficulties and increased heat dissipation in the ECM. Accordingly, what is needed is a more cost effective control apparatus that achieves staggered spark plug firing without increasing the number of ECM outputs, and without requiring additional up-integrated ignitors in the ECM.

SUMMARY OF THE INVENTION

The present invention is directed to an improved control apparatus for achieving staggered spark plug firing in a dual-plug spark ignition engine wherein first and second spark plugs for any given engine cylinder are controlled by a single ECM output. The ECM output initiates firing of the first spark plug, and a detection and delay circuit packaged with an ignition coil and ignitor for second spark plug initiates delayed firing of the second spark plug relative to the first spark plug. In a preferred embodiment, the detection and delay circuit also detects engine speed based on the firing frequency of the first spark plug, and adjusts the firing delay time so that the firing of the second spark plug is delayed with respect to the firing of the first spark plug by a calibrated angle of engine rotation.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
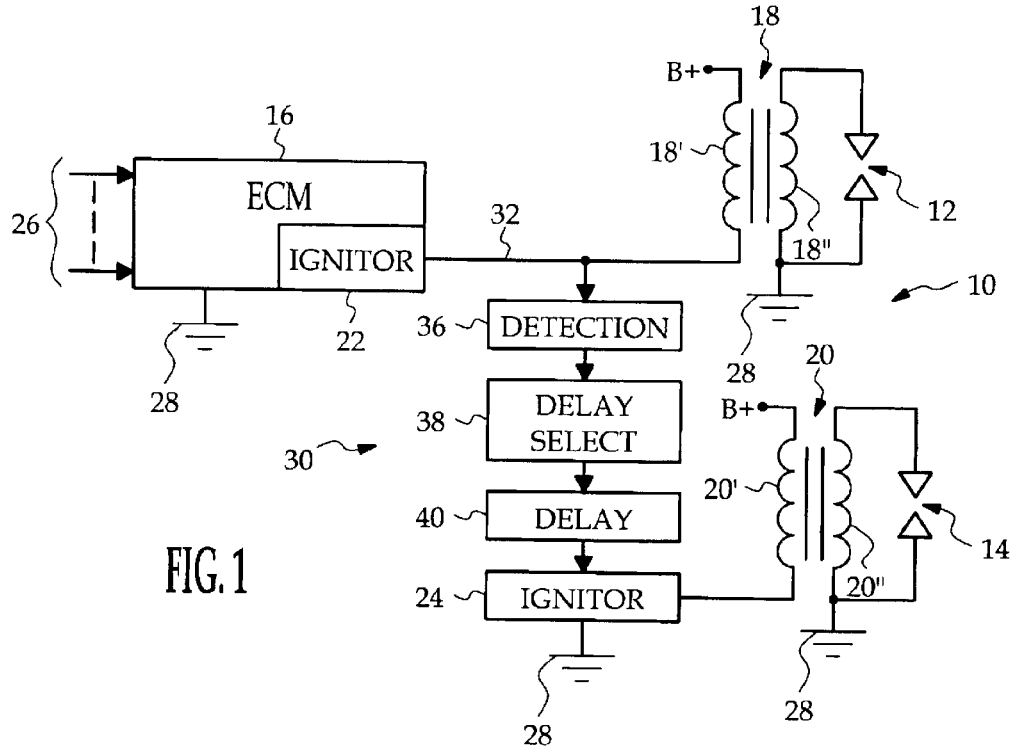
FIG. 1 is a block diagram of an ignition control apparatus for a dual plug spark ignition engine, including a microprocessor-based ECM having an up-integrated ignitor for the first of two spark plugs and a delay control circuit for the second of the two spark plugs according to a first embodiment of this invention.
Figure 2:
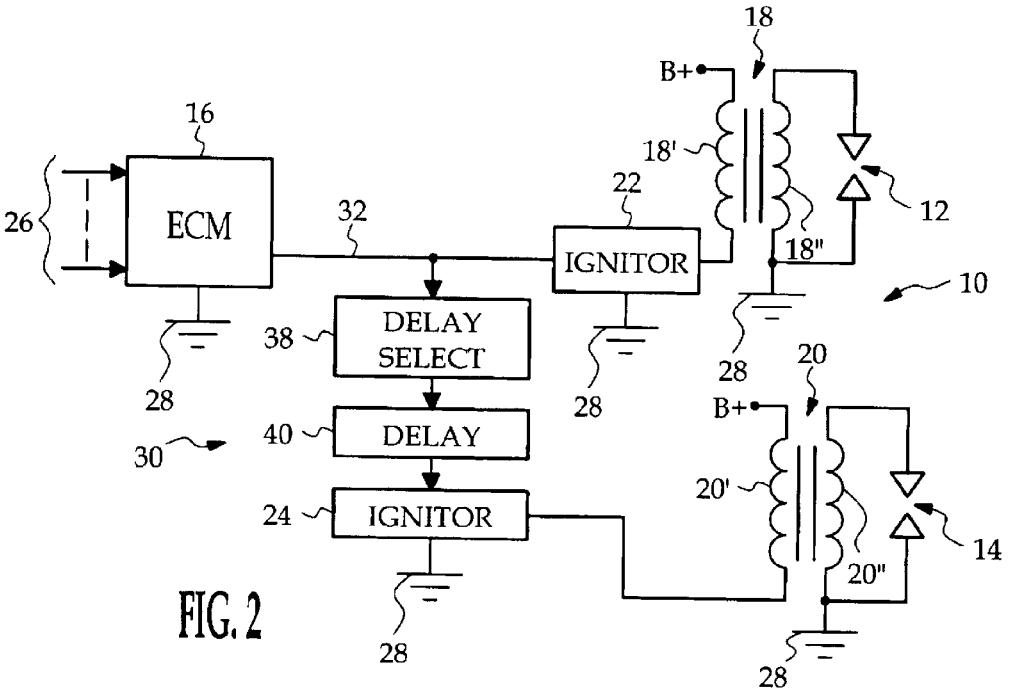
FIG. 2 is a block diagram of an ignition control apparatus for a dual plug spark ignition engine, including a microprocessor-based ECM and a delay control circuit for the second of two spark plugs according to a second embodiment of this invention.

Referring to the drawings, and particularly to FIGS. 1 and 2, the reference numeral 10 generally designates an ignition circuit for a given cylinder of a dual-plug spark-ignition internal combustion engine. The two spark plugs 12 and 14 produce staggered spark discharges in the combustion stroke of the given cylinder under the control of a microprocessor-based engine control module (ECM) 16. In the illustrated configuration, each of the spark plugs 12, 14 has an associated ignition coil (transformer) 18, 20 and a coil driver circuit or ignitor 22, 24 coupled to the primary winding 18', 20' of the respective ignition coil 18, 20. In addition, the ignition coils 18, 20 are packaged with the respective spark plugs 12, 14 in a so-called coil-at-plug configuration. In the embodiment of FIG. 1, the ignitor 22 associated with spark plug 12 is up-integrated into ECM 16, whereas in the embodiment of FIG. 2, the ignitor 22 is packaged remote from ECM 16, such as with the ignition coil 18.

In general, the ECM 16 determines an ignition dwell time $T_{dwell}$ based on various inputs 26, and the ignitors 22 and 24 energize the respective primary windings 18', 20' for the determined dwell time by establishing a conduction path between the respective primary windings 18', 20' and battery ground 28. When the primary winding energization is interrupted at the end of the dwell period, the stored inductive energy is coupled to the respective secondary windings 18", 20", producing a spark discharge at the respective spark plug 12, 14. The dwell and ensuing spark discharge periods $T_{dwell}$ and $T_{disch}$ are designated in Graph A of FIG. 3, which depicts a representative output voltage of ignitor 22 or 24.

Figure 3:
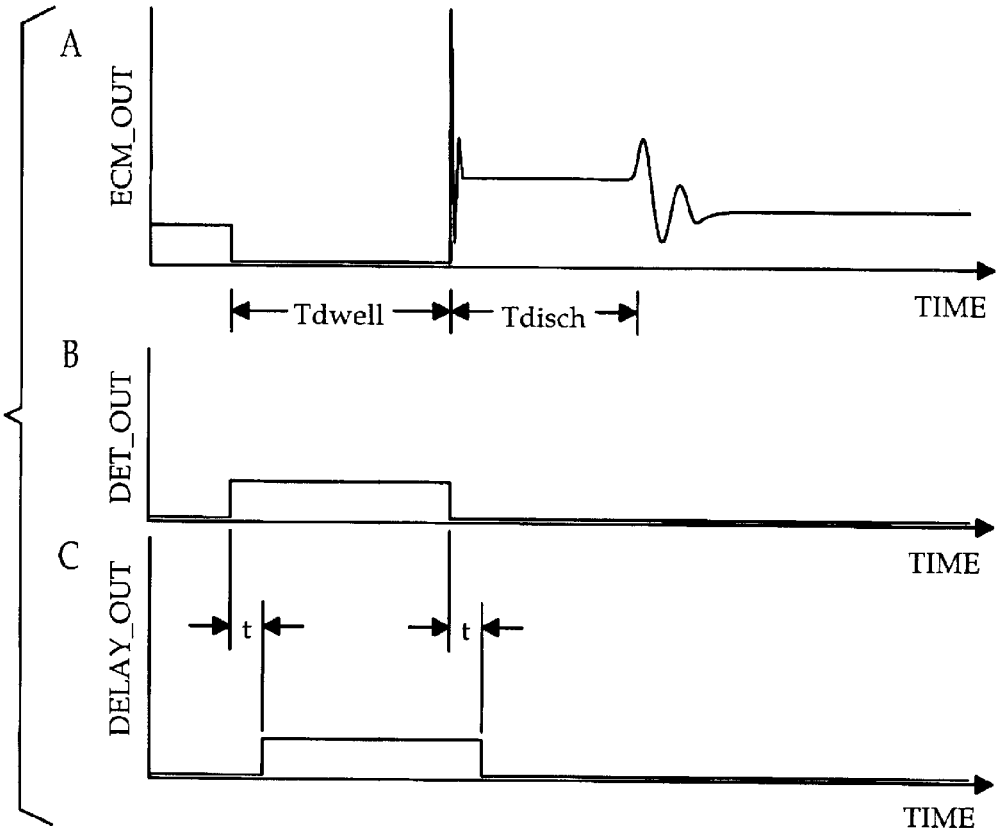
FIG. 3, Graphs A–C, graphically depicts the operation of the delay control circuits of FIGS. 1 and 2.

The present invention achieves staggered firing of the spark plugs 12 and 14 with a single EMC output through the use of a delay control circuit 30 responsive to the single ECM output on line 32. Essentially, the ECM 16 directly triggers the ignitor 22, which causes the delay control circuit 30 to trigger the ignitor 24 following a delay period. As a result, the spark discharge at spark plug 14 is time-delayed or staggered relative to the spark discharge at spark plug 12. In the embodiment of FIG. 1 where the ignitor 22 is integrated into ECM 16, the signal on output line 32 resembles the trace depicted in Graph A of FIG. 3, and the delay control circuit includes a detection circuit 36 coupled to output line 32 for detecting signal transitions associated with the dwell period $T_{dwell}$ and a delay circuit 40 for producing a dwell pulse for ignitor 24 that is delayed with respect to the dwell period of ignitor 22. Graph B of FIG. 3 depicts a detected dwell interval (DET_OUT) based on the ECM output signal (ECM_OUT) of Graph A, and Graph C depicts a corresponding dwell pulse (DELAY_OUT) that has been delayed by the delay time t. The embodiment of FIG. 2 is like the embodiment of FIG. 1, except that the ECM output on line 32 is a simply logic level signal, which eliminates the need for detection circuit 36. Preferably, the delay control circuit 30 of both embodiments also includes a delay select circuit 38 responsive to the dwell interval of ignitor 22 for selecting a delay time t that delays the spark discharge of spark plug 14 by a calibrated angle of engine rotation, as opposed to a calibrated time. This functionality is achieved by detecting the engine speed based on the elapsed time between successive dwell intervals of ignitor 22 (i.e., the firing frequency of spark plug 12), and computing or retrieving a delay time t based on the detected engine speed so that the delay angle remains substantially constant.

In summary, the apparatus of the present invention achieves staggered spark plug firing in a dual plug spark ignition engine without impacting the design or functionality of ECM 16. The modest cost of the delay control circuit 30 is incurred in place of the relatively high costs associated with increasing the number of ECM outputs and integrating additional ignitors into ECM 16, in the case of the up-integrated ECM of FIG. 1. While described in reference to the illustrated embodiments, it is expected that various modifications in addition to those mentioned above will occur to those skilled in the art. For example, the invention can be extended to engines having more than two spark plugs per cylinder, and so on. Accordingly, it will be understood that ignition systems incorporating these and other modifications may fall within the scope of this invention, which is defined by the appended claims.

What is claimed is:

1. Apparatus for initiating staggered firing of first and second spark plugs in a dual plug internal combustion engine, comprising:

a control module for determining a dwell interval;

means including a first ignitor coupled to said control module for activating a first ignition coil associated with said first spark plug for said dwell interval to precipitate firing of said first spark plug;

delay control means responsive to an output of said control module for producing an activation control signal for a second ignition coil associated with said second spark plug, said activation control signal being time delayed with respect to the dwell interval determined by said control module; and means including a second ignitor for activating said second ignition coil in accordance with the activation control signal produced by said delay control means to precipitate firing of said second spark plug that is time delayed with respect to the firing of said first spark plug.

2. The apparatus of claim 1, wherein said first ignitor is integrated into said control module, and said output of said control module is an output of said first ignitor.

3. The apparatus of claim 2, wherein said delay control means comprises:

means for detecting the activation of said first ignition coil by said first ignitor; and means for producing an activation control signal that is delayed with respect to the detected activation of said first ignition coil, and for activating said second ignitor in accordance with said activation control signal.

4. The apparatus of claim 1, further comprising:

means for adjusting the time delay of said delay control means so that the firing of said second spark plug is delayed with respect to the firing of said first spark plug by a calibrated angle of engine rotation.

5. The apparatus of claim 1, wherein said delay control means further comprises:

means for detecting an engine speed based on a firing frequency of said first spark plug; and means for selecting the time delay of said activation control signal based on said detected engine speed.

* * * * *